US010071457B2

(12) United States Patent
Mizutani et al.

(10) Patent No.: US 10,071,457 B2
(45) Date of Patent: Sep. 11, 2018

(54) CAM GRINDING DEVICE AND CAM GRINDING METHOD

(71) Applicant: JTEKT CORPORATION, Osaka-shi (JP)

(72) Inventors: Yoshihiro Mizutani, Kitanagoya (JP); Satoshi Abeta, Chita (JP); Masaharu Inoue, Obu (JP)

(73) Assignee: JTEKT CORPORATION, Osaka-shi (JP)

( * ) Notice: Subject to any disclaimer, the term of this patent is extended or adjusted under 35 U.S.C. 154(b) by 106 days.

(21) Appl. No.: 15/365,345

(22) Filed: Nov. 30, 2016

(65) Prior Publication Data

US 2017/0157730 A1 Jun. 8, 2017

(30) Foreign Application Priority Data

Dec. 2, 2015 (JP) ..... 2015-235285

(51) Int. Cl.
*B24B 19/12* (2006.01)
*B24B 1/00* (2006.01)
*B24B 5/04* (2006.01)

(52) U.S. Cl.
CPC ..... *B24B 19/125* (2013.01); *B24B 1/00* (2013.01); *B24B 5/04* (2013.01); *B24B 19/12* (2013.01)

(58) Field of Classification Search
CPC .. B24B 1/00; B24B 5/04; B24B 19/12; B24B 19/125
USPC ..... 451/5, 9, 10, 11, 49, 249, 251
See application file for complete search history.

(56) References Cited

U.S. PATENT DOCUMENTS 4,312,154 A * 1/1982 Fournier ..... B24B 19/12 451/239
5,392,566 A * 2/1995 Wedeniwski ..... B24B 19/12 451/11
5,655,953 A * 8/1997 Murakami ..... B24B 5/045 451/10
6,200,200 B1 * 3/2001 Himmelsbach ..... B24B 19/12 451/195
2009/0223049 A1 * 9/2009 Binder ..... B24B 19/12 29/888.1

(Continued)

FOREIGN PATENT DOCUMENTS

DE 103 33 916 B4 10/2010
JP 4-13560 1/1992

OTHER PUBLICATIONS

U.S. Appl. No. 15/350,680, filed Nov. 14, 2016, 20170144264, Yoshihiro Mizutani, et al.

*Primary Examiner* — Eileen Morgan
(74) *Attorney, Agent, or Firm* — Oblon, McClelland, Maier & Neustadt, L.L.P.

(57) ABSTRACT

A cam grinding method using a cam grinding device includes: an intermediate-cam lift-data generating step of, based on first lift data of a first cam and second lift data of a second cam, generating imaginary intermediate cam lift data of a spline curve that contains profiles of both cams; a first cam grinding step of grinding the first cam; a second cam grinding step of grinding the second cam; and an intermediate-cam grinding step of removing an unground portion generated at a boundary portion between the first cam and the second cam by plunge grinding or spark-out grinding on the basis of the intermediate-cam lift data after the second cam grinding step.

3 Claims, 15 Drawing Sheets

(56) References Cited

U.S. PATENT DOCUMENTS

2017/0274492 A1* 9/2017 Inoue ..... F16H 53/025

* cited by examiner

CAM GRINDING DEVICE AND CAM GRINDING METHOD

INCORPORATION BY REFERENCE

The disclosure of Japanese Patent Application No. 2015-235285 filed on Dec. 2, 2015 including the specification, drawings and abstract, is incorporated herein by reference in its entirety.

BACKGROUND OF THE INVENTION

1. Field of the Invention

The present invention relates to a cam grinding device and a cam grinding method. Specifically, the present invention relates to a grinding device for a composite cam in which two cams having different cam lift amounts and different phase angles are arranged adjacently in the axial direction and a cam grinding method thereof.

2. Description of the Related Art

Suction into and discharge from cylinders of an internal combustion engine are performed by valve-opening operation of valves. This valve-opening operation of valves is performed by operation of cams that rotate.

In the valve-opening operation of valves, from a viewpoint of improving output of the internal combustion engine, for example, valve-opening operation control is performed differently between at a low-speed rotation and at a high-speed rotation of the internal combustion engine.

In one of such control methods, a first cam for low speed and a second cam for high speed are provided as cams that actuate each valve, and valve-opening control is performed by appropriately selecting the first cam and the second cam in accordance with the rotational speed of the internal combustion engine. In this case, selective switching between the first cam and the second cam is performed by relative movement of a tappet of the valve between the first cam and the second cam in the axial direction while the tappet is in contact with the cams.

FIG. 13 to FIG. 15 are schematic diagrams illustrating positional relations between a first cam 112 for low speed and a second cam 114 for high speed. As can be seen from these schematic diagrams, in general, the maximum lift height of the first cam 112 for low speed is set low, and the maximum lift height of the second cam 114 for high speed is set greater than that of the first cam 112. The phase angles of both cams 112 and 114 are set such that the second cam 114 for high speed precedes in phase the first cam 112 for low speed in the rotation direction (arrow direction in FIG. 13), that is, valve-opening operation of a valve at the second cam 114 is performed earlier. Accordingly, as depicted in FIG. 13, the cam profile of the second cam 114 for high speed in the lift-height direction and the cam profile of the first cam 112 for low speed in the lift-height direction are offset from each other in the angular direction, and are in a positional relation in which these cams protrude from each other when viewed from the cam axial direction.

As depicted in FIG. 14 and FIG. 15, the first cam 112 for low speed and the second cam 114 for high speed are arranged adjacently in the axial direction. In other words, both cams are arranged as a composite cam 110. In this case, base circular portions of the first cam 112 for low speed and the second cam 114 for high speed are both formed by a constant radius r from a camshaft center. A certain angular range in which the base circular portions of both cams overlap is a common-base circular portion C. In the range of this common-base circular portion C, the relative movement of the tappet between the first cam 112 and the second cam 114 while the tappet is in contact with the cams is performed.

Cam grinding of the composite cam 110 including the first cam 112 for low speed and the second cam 114 for high speed is generally performed with a grinding wheel T (see FIG. 14 and FIG. 15) in a cam grinding device. In this grinding of the composite cam 110, after one cam of the first cam 112 and the second cam 114 is plunge ground, the other cam is plunge ground.

For example, the case depicted in FIG. 14 and FIG. 15 is a case in which the first cam 112 for low speed is ground first and the second cam 114 for high speed is ground later. In this case, the first cam 112 is ground with the grinding wheel T on the basis of predetermined cam lift data of the first cam 112 for low speed. Subsequently, the grinding wheel T is moved to a position corresponding to the second cam 114 for high speed, and the second cam 114 is ground with the grinding wheel T on the basis of predetermined cam lift data of the second cam 114 for high speed. In this manner, the composite cam 110 is ground by the cam grinding device. For example, see the specification of German Patent No. 10333916 and Japanese Patent Application Publication No. H4-13560.

In the grinding of the composite cam 110 with the grinding wheel T performed by the cam grinding device described above, as depicted in FIG. 15, at a boundary portion between the first cam 112 and the second cam 114 in the range of the common-base circular portion of the first cam 112 and the second cam 114, an unground portion F that is left unground is problematically generated. Illustrations of the unground portion F depicted in FIG. 14 and FIG. 15 are illustrated in an exaggerated manner for the purpose of easy understanding. Specifically, the unground portion F has a size on the order of several micrometers.

When the unground portion F exists at the boundary portion between the first cam 112 and the second cam 114 in the range of the common-base circular portion C, relative movement of the tappet between the first cam 112 and the second cam 114 requires the tappet to get over this unground portion F. This makes it difficult to perform this movement smoothly, thereby affecting the valve-opening control of the valve. Thus, the grinding wheel T needs to be trued frequently.

The following specifically describes the problem that the unground portion F is generated. In general, as depicted in FIG. 14 and FIG. 15, the axial direction width of the grinding wheel T is greater than the axial direction widths of the first cam 112 for low speed and the second cam 114 for high speed. Both ends Ta and Tb of the grinding wheel T on the grinding surface side become blunt by grinding the cams as workpieces. Specifically, both ends Ta and Tb wear sooner than a central portion, and the blunting is caused.

In view of this, herein, as depicted in FIG. 14, when the first cam 112 for low speed is plunge ground, the grinding wheel T is positioned so that the right end Ta thereof is aligned with the boundary portion between the first cam 112 and the second cam 114. Accordingly, the left end Tb of the grinding wheel T is positioned projecting beyond the left side of the first cam 112. Thus, the blunting at the left end Tb of the grinding wheel T does not affect the grinding of the first cam 112. However, the blunting at the right end Ta of the grinding wheel T affects the grinding on the first cam side at the boundary portion between the first cam 112 and the second cam 114, thereby causing an unground portion F to remain. The black-filled portion in FIG. 14 is the unground portion F. In FIG. 14 and FIG. 15, grinding allowances of the first cam 112 and the second cam 114 are indicated by imaginary lines. It should be noted that these lines are also drawn in an exaggerated manner for the purpose of easy understanding.

Subsequently, after the grinding of the first cam 112 is completed, as depicted in FIG. 15, the grinding wheel T is relatively moved to the position of the second cam 114, and the second cam 114 is plunge ground with the grinding wheel T. In this plunge grinding, the grinding wheel T is positioned so that the left end Tb thereof is aligned with the boundary portion between the first cam 112 and the second cam 114. Accordingly, the right end Ta of the grinding wheel T is positioned projecting beyond the right side of the second cam 114, and thus the blunting at the right side of the grinding wheel T does not affect the grinding of the second cam 114. However, the blunting at the left end Tb of the grinding wheel T affects the grinding on the second cam side at the boundary portion between the first cam 112 and the second cam 114, thereby causing an unground portion F to remain. This unground portion F in FIG. 15 and the unground portion F of the first cam 112 in FIG. 14 are both illustrated, filled with black, and remain at the boundary portion between the first cam 112 and the second cam 114.

SUMMARY OF THE INVENTION

An object of the present invention is to provide a cam grinding device that can remove an unground portion that is generated at a boundary portion in a common-base circular portion between a first cam and a second cam of a composite cam having different cam lift heights, by generating an imaginary intermediate cam containing profiles of the first cam and the second cam and grinding this intermediate cam.

A composite cam to be ground by a cam grinding device according to one aspect of the present invention includes: a first cam having a first base circular portion in which lift height from a shaft center to an outer peripheral surface is formed by a first radius that is constant and a first cam portion in which the lift height from the shaft center to the outer peripheral surface changes; and a second cam having a second base circular portion in which lift height from the shaft center to an outer peripheral surface is formed by the first radius that is constant and a second cam portion in which the lift height from the shaft center to the outer peripheral surface changes. The first cam and the second cam are arranged adjacently in an axial direction so as to be coaxial, and have shapes that respectively correspond to first cam lift data and second cam lift data that are different from each other. Furthermore, at least part of the outer peripheral surface of the first base circular portion and at least part of the outer peripheral surface of the second base circular portion form a common-base circular portion on an identical surface.

The cam grinding device includes: a bed serving as a base; a spindle device mounted on the bed and including a workpiece rotating device configured to support the composite cam rotatably about the shaft center; a grinding-wheel device mounted on the bed and including a grinding wheel configure to rotate; a traverse-moving device that is capable of reciprocating the grinding wheel relatively to the composite cam in the axial direction; a plunge-moving device that is capable of moving the grinding wheel relatively to the composite cam in a direction crossing the axial direction; and a control device configured to control the workpiece rotating device, the traverse-moving device, and the plunge-moving device.

Furthermore, the control device includes: a common-base circular-portion setting unit configured to determine an angular range of the common-base circular portion that is formed on the identical surface by the at least part of the outer peripheral surface of the first base circular portion and the at least part of the outer peripheral surface of the second base circular portion, based on the first cam lift data that contains a lift amount corresponding to a rotational angle in the first cam and the second cam lift data that contains a lift amount corresponding to a rotational angle in the second cam; an intermediate-cam lift-data generating unit configured to generate intermediate-cam lift data of an imaginary intermediate cam that contains a profile of the first cam and a profile of the second cam when viewed from the axial direction, based on the first cam lift data and the second cam lift data; a first cam grinding unit that controls the plunge-moving device and the traverse-moving device to move the grinding wheel to a position facing the outer peripheral surface of the first cam, and controls the workpiece rotating device and the plunge-moving device based on the first cam lift data to grind the first cam; a second cam grinding unit that, in a state in which the grinding wheel has retreated from the composite cam after the first cam has been ground, controls the traverse-moving device to move the grinding wheel to a position facing the outer peripheral surface of the second cam, and controls the workpiece rotating device and the plunge-moving device based on the second cam lift data to grind the second cam; and an intermediate-cam grinding unit that, in a state in which the grinding wheel has retreated from the composite cam after the second cam has been ground, controls the traverse-moving device to move the grinding wheel to a position corresponding to a boundary between the first cam and the second cam, and controls the workpiece rotating device and the plunge-moving device based on the intermediate-cam lift data to grind the imaginary intermediate cam lying on the boundary between the first cam and the second cam.

When the first cam and the second cam of the composite cam have been ground with the grinding wheel by the first cam grinding unit and the second cam grinding unit, an unground portion remains at the boundary portion in the common-base circular portion between both cams. The cam grinding device of the above aspect removes this unground portion as follows.

To begin with, the lift data of the imaginary intermediate cam containing the profile of the first cam and the profile of the second cam when viewed from the cam axial direction is generated based on the first lift data of the first cam and the second lift data of the second cam. Thus, this lift data of the imaginary intermediate cam contains the angular range of the common-base circular portion of the first cam and the second cam in which the unground portion problematically remains.

After the grinding of the first cam and the second cam has been completed, the imaginary intermediate cam lying on the boundary between the first cam and the second cam is ground based on the lift data of the intermediate cam, whereby the unground portion at the boundary portion is removed.

In the cam grinding device of the aspect, grinding of the first cam and grinding of the second cam respectively performed by the first cam grinding unit and the second cam grinding unit may each include rough grinding, fine grinding, and spark-out.

With the cam grinding device of the aspect, cam grinding time can be shortened, and the cams can be ground accurately.

With the cam grinding device of the aspect, the unground portion generated at the boundary portion in the common-base circular portion between the first cam and the second cam of the composite cam having different cam lift heights can be removed by generating the imaginary intermediate cam containing the profiles of the first cam and the second cam and grinding this intermediate cam.

Furthermore, even if the cam profile of the first cam in the lift-height direction and the cam profile of the second cam in the lift-height direction are offset from each other in the angular direction, and are in a positional relation in which these cams protrude from each other when viewed from the cam axial direction, the unground portion can be reliably ground by grinding the intermediate cam.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
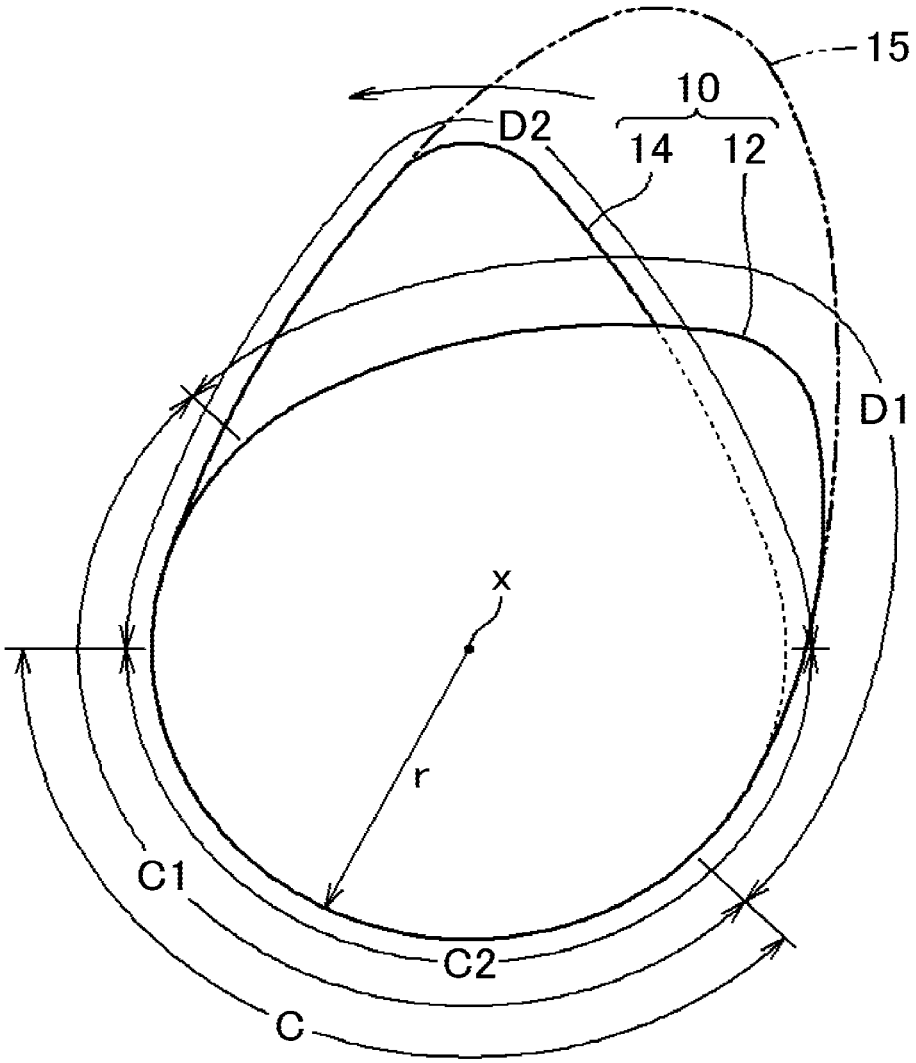
FIG. 1 is a schematic diagram of a composite cam in the present embodiment when viewed from a cam axial direction.
Figure 2:
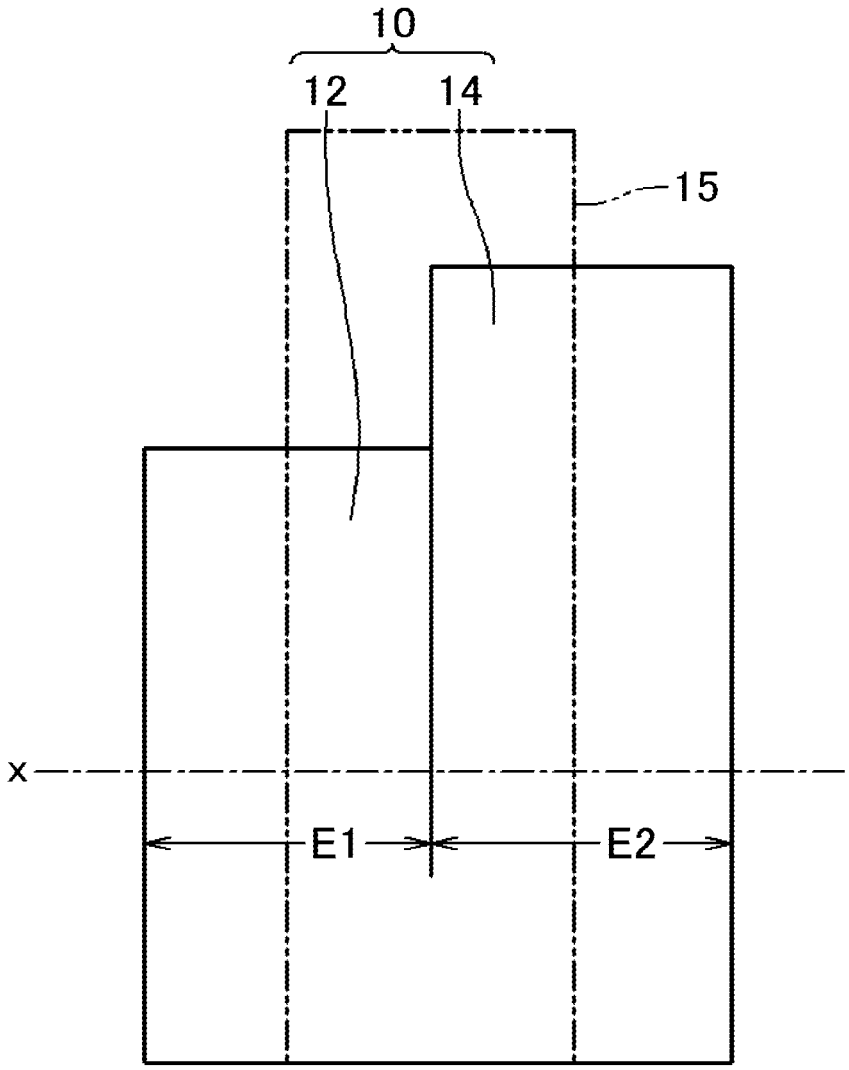
FIG. 2 is a side view of a first cam and a second cam included in the composite cam when viewed from a direction orthogonal to the cam axis.

An embodiment of the present invention will now be described with reference to the drawings. The following describes a composite cam 10 in the present embodiment. FIG. 1 is a schematic diagram of the composite cam 10 when viewed from a cam axis x direction. FIG. 2 is a side view illustrating a first cam 12 and a second cam 14 included in the composite cam 10 when viewed from a direction orthogonal to the cam axis x, in which each cam is illustrated at its maximum lift height position.

As depicted in FIG. 2, the composite cam 10 of the present embodiment is structured such that the first cam 12 and the second cam 14 are arranged adjacently in the axial direction. In the present embodiment, the first cam 12 is a cam for low speed, and the second cam 14 is a cam for high speed. The maximum lift height of the first cam 12 for low speed is lower than the maximum lift height of the second cam 14 for high speed. As depicted in FIG. 2, it is assumed herein that the first cam 12 for low speed and the second cam 14 for high speed have the same width in the axial direction x. Specifically, the width E1 of the first cam 12 and the width E2 of the second cam are the same.

As depicted in FIG. 1, the first cam 12 for low speed and the second cam 14 for high speed have different phase angles. With respect to the rotation direction (arrow direction in FIG. 1) of an internal combustion engine, the phase of the second cam 14 for high speed is ahead of that of the first cam 12 for low speed. Accordingly, valve-opening operation of valves in the internal combustion engine is performed earlier by the second cam 14 than by the first cam 12. In the present embodiment, the cam profile of the second cam 14 for high speed in the lift-height direction and the cam profile of the first cam 12 for low speed in the lift-height direction are offset from each other in the angular direction, and are in a positional relation in which these cams protrude from each other when viewed from the cam axial direction. Herein, even when the cam profile of either one of the two cams is contained within the cam profile of the other one, phases thereof at the respective maximum cam height positions may be different.

As depicted in FIG. 1, the cam outer shape of each of the first cam 12 and the second cam 14 includes a base circular portion that is formed by a constant first radius r from the cam axis x and a cam-height-changing profile portion other than this base circular portion. In FIG. 1, a first base circular portion of the first cam 12 is denoted by C1, and the cam-height-changing profile portion thereof is denoted by D1. In the same manner, a second base circular portion of the second cam 14 is denoted by C2, and the cam-height-changing profile portion thereof is denoted by D2. Because the cam height and the phase angle of the first cam 12 are different from those of the second cam 14, the range of the first base circular portion C1 is different from that of the second base circular portion C2. Portions that are formed on the same surface and overlap each other in the first base circular portion C1 and the second base circular portion C2 of both cams 12 and 14 are illustrated as a common-base circular portion C in FIG. 1.

Figure 3:
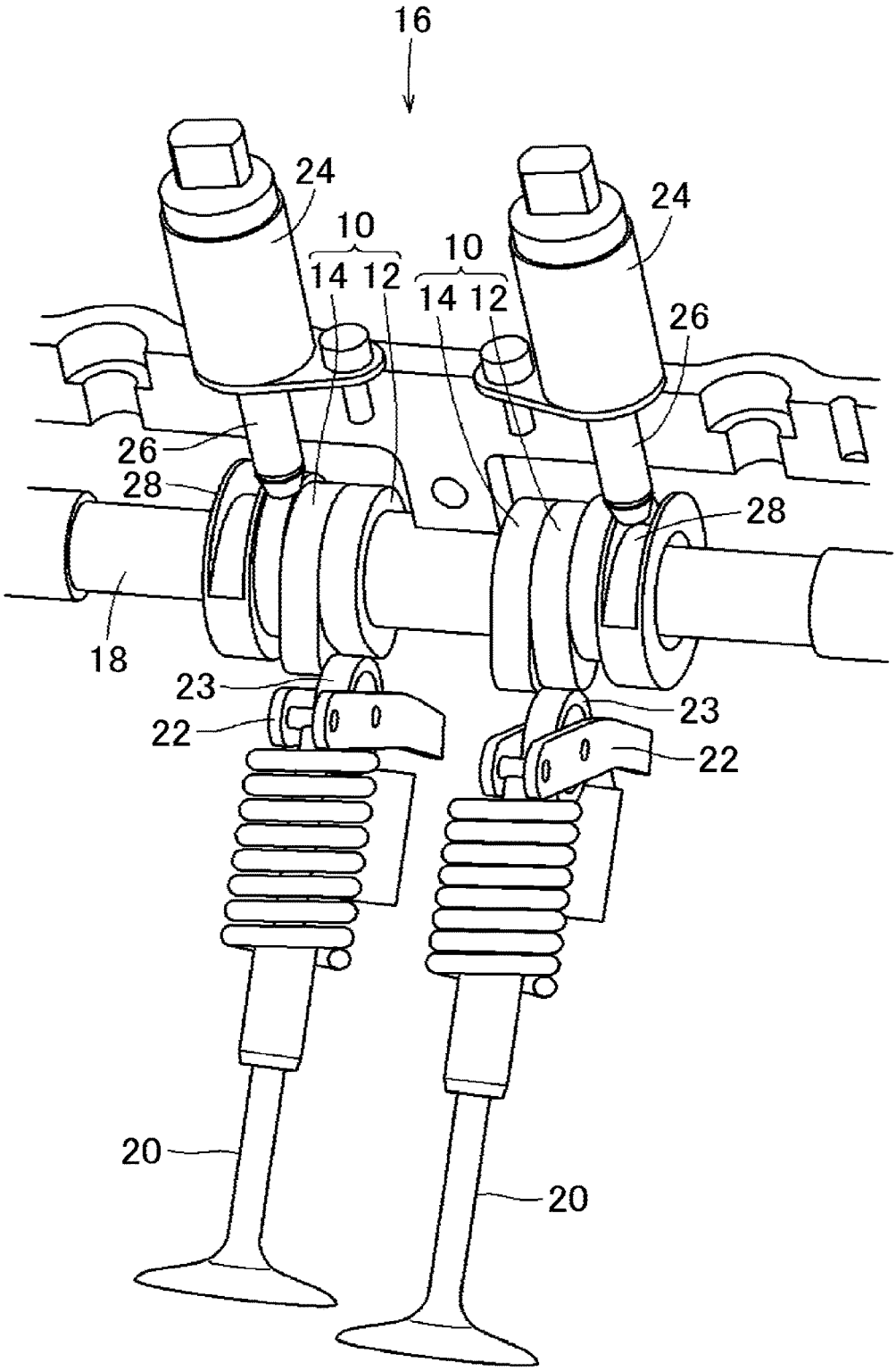
FIG. 3 is a perspective view of an embodiment illustrating one example of a cam control mechanism configured to selectively control the composite cam.

FIG. 3 is a perspective view of an embodiment illustrating one example of a cam control mechanism 16 configured to selectively control the first cam 12 and the second cam 14 in a camshaft 18 including the composite cam 10. The first cam 12 and the second cam 14 are arranged on the camshaft 18, and the first cam 12 and the second cam 14 are arranged for a valve 20 and are integrated with each other to constitute the composite cam 10. In the present embodiment, the composite cam 10 is provided in two sets, and each of the composite cams 10 is rotatable integrally with the camshaft 18 and movable in the axial direction.

Each valve 20 is vertically moved by oscillating motion of a tappet 22. Each tappet 22 is selectively brought into contact with the corresponding first cam 12 or the corresponding second cam 14, and is caused to oscillate by the cam 12 or 14. Specifically, a tappet roller 23 provided to each tappet 22 is brought into contact with the corresponding cam 12 or 14. The tappet 22 is selectively brought into contact with the cam 12 or 14 by engagement of a pin 26 of an actuator 24 such as an electromagnetic solenoid with a spiral-grooved element 28 that is arranged integrally with a side portion of each composite cam 10. On the outer peripheral surface of each spiral-grooved element 28, an axially spiral groove is formed. Each pin 26 engages with this spiral groove, and the camshaft 18 and the composite cams 10 rotate, whereby the two sets of composite cams 10 are moved in the axial direction. The spiral grooves of the spiral-grooved elements 28 arranged right and left are formed in the same direction. For example, with the spiral groove of one of the spiral-grooved elements 28, the corresponding pin 26 engages, and the composite cams 10 are moved rightward. Furthermore, with the spiral groove of the other of the spiral-grooved elements 28, the corresponding pin 26 engages, whereby the composite cams 10 are moved leftward. Consequently, positions of the cams coming into contact with the tappets 22 are switched. Herein, switching operation by the actuator 24 is performed when the tappet 22 comes into contact with the first cam 12 or the second cam 14 on the common-base circular portion C.

Figure 4:
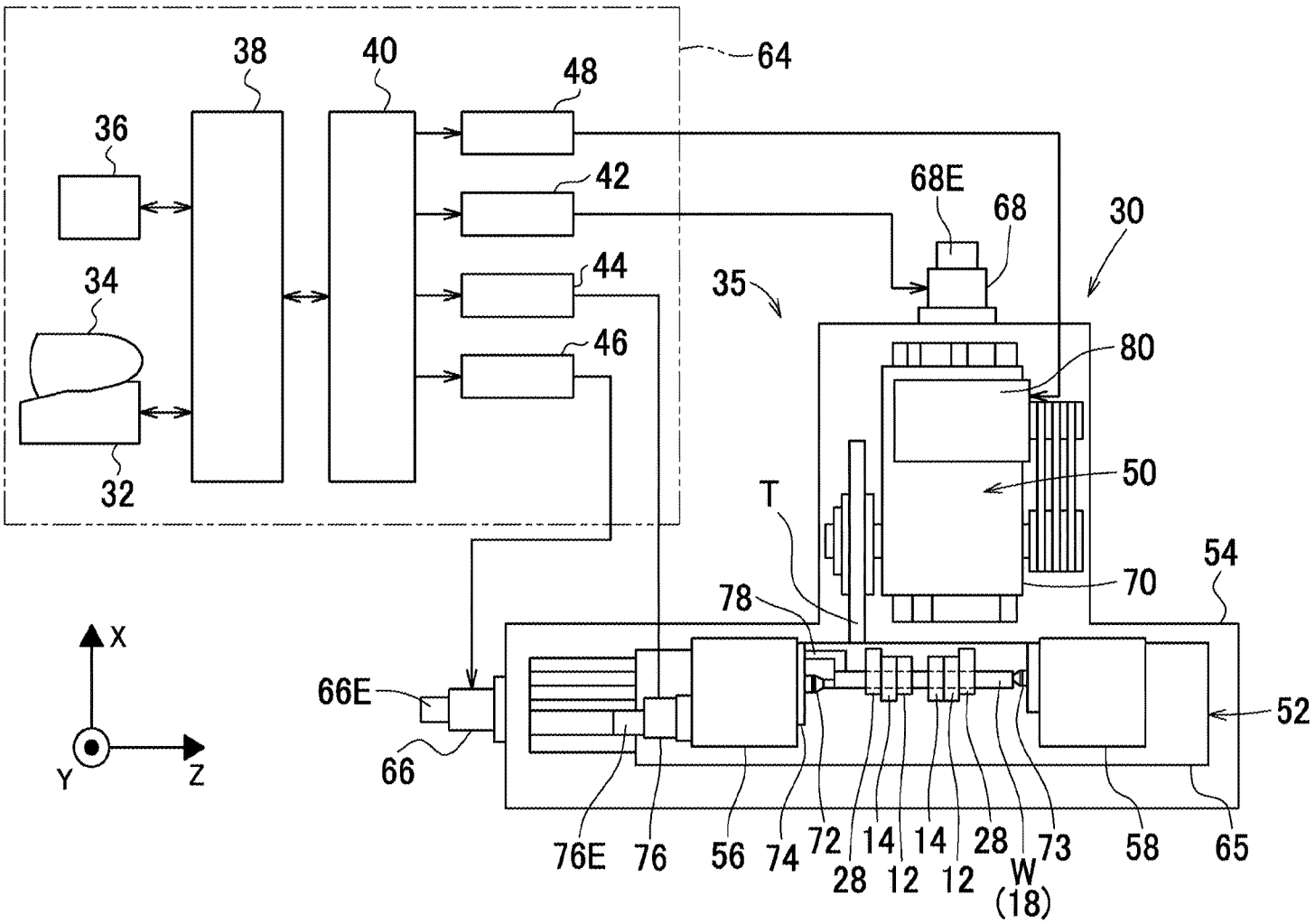
FIG. 4 is a plan view of a cam grinding device.
Figure 5:
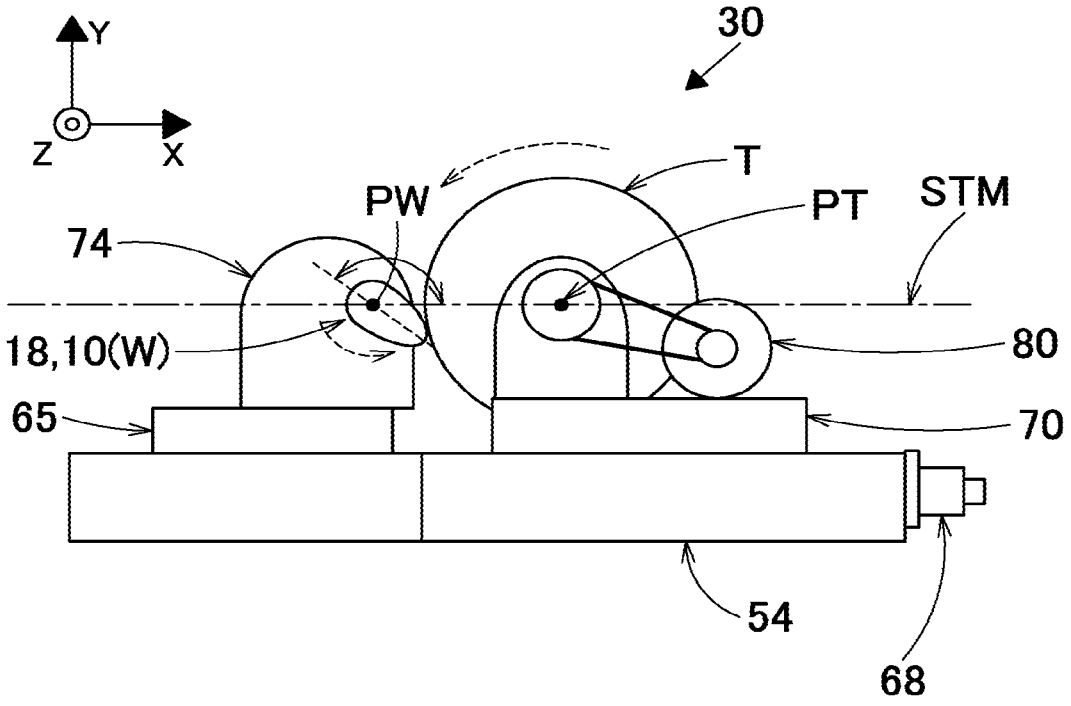
FIG. 5 is a right side view of the cam grinding device.

The following describes a cam grinding device 30 with reference to FIG. 4 and FIG. 5. FIG. 4 is a plan view, and FIG. 5 is a right side view. In FIG. 5, illustration of a tailstock 58 in FIG. 4 is omitted. The X-axis, the Y-axis, and the Z-axis illustrated in FIGS. 4 and 5 are orthogonal to each other. The Y-axis direction indicates a vertically upward direction. The X-axis direction and the Z-axis direction indicate horizontal directions orthogonal to each other.

The cam grinding device 30 of the present embodiment is a grinding device that rotates and supports the camshaft 18 as a workpiece W including the composite cams 10 to grind the cams with a cylindrical grinding wheel T. As depicted in FIG. 4, the cam grinding device 30 includes an input device 32 such as a keyboard, a display device 34 such as a monitor, a data reading device 36 such as a tape reader, an automatic programming device 38, a numerical controller 40, drive units 42, 44, 46, and 48, a grinding-wheel device 50, and a workpiece support device 52.

The data reading device 36 reads various types of data in accordance with operation of an operator using the input device 32 and the display device 34. In this case, cam lift data for identifying the shape of each composite cam 10 to be ground and the diameter of the grinding wheel T are read. In the present embodiment, cam lift data for two cams having different phases and different cam lift heights depicted in FIG. 1 is read. Specifically, first cam lift data of the first cam 12, second cam lift data of the second cam 14, an angle from a reference phase to a phase at the maximum lift of the first cam 12, and an angle from a reference phase to a phase at the maximum lift of the second cam 14 are read. The reference phase of the first cam 12 and the reference phase of the second cam 14 are the same. The first cam lift data and the second cam lift data contain a plurality of phases and a plurality of cam lift heights provided at regular intervals in the circumferential direction.

To the input device 32, pieces of data specifically recited as follows are input by the operator seeing the display device 34. The pieces of input data are:

(a) width E1 of the first cam 12, (b) width E2 of the second cam 14, (c) width G and diameter H of the grinding wheel T, (d) rotational speed m1 of the grinding wheel T, rotational speed n1 of a spindle 74, infeed amount J of the grinding wheel T during idle grinding, (e) rotational speed m2 of the grinding wheel T, rotational speed n2 of the spindle 74, infeed amount K of the grinding wheel T during rough grinding, (f) rotational speed m3 of the grinding wheel T, rotational speed n3 of the spindle 74, infeed amount M of the grinding wheel T during fine grinding, (g) rotational speed m4 of the grinding wheel T, rotational speed n4 of the spindle 74, rotation amount of the spindle 74 during spark-out, and (h) rotational speed m5 of the grinding wheel T, rotational speed n5 of the spindle 74, rotation amount of the spindle 74 during removal of an unground portion.

The pieces of data (d) to (g) are input for each of a first cam grinding step and a second cam grinding step described later, and the automatic programming device 38 automatically creates a program for the first cam grinding step and a program for the second cam grinding step.

The cam grinding device 30 includes a bed 54 as a base on which various devices are mounted. On this bed 54, a work table 65 that can be moved back and forth in the Z-axis direction by a work-table driving device 66 and a wheel head 70 that can be moved back and forth in the X-axis direction by a wheel-head driving device 68 are mounted. The work-table driving device 66 in the present embodiment corresponds to the traverse-moving device in the present invention, and the wheel-head driving device 68 corresponds to the plunge-moving device.

On the work table 65, a spindle device 56 including a spindle 74 configured to rotate about a spindle rotation axis that is parallel to the Z-axis and passes through the center of a center 72 and the tailstock 58 including a center 73 provided on the spindle rotation axis are mounted. The spindle 74 can be rotated by a spindle driving device 76. This spindle driving device 76 corresponds to the workpiece rotating device of the present invention. The camshaft 18 as the workpiece W including the composite cams 10 is supported between the center 72 and the center 73. In the spindle 74, a positioning pin 78 is formed so as to align the rotation phase of the camshaft 18 as the workpiece W with the rotation phase of the spindle 74. In the camshaft 18 as the workpiece W, a fitting portion (not depicted) into which the positioning pin 78 is fitted is formed. This allows the camshaft 18 to be positioned and supported so that the positioning pin 78 is fitted into the fitting portion.

On the wheel head 70, the grinding wheel T is mounted that is rotated by a grinding-wheel driving device 80 such as a motor. In the present embodiment, these components constitute the grinding-wheel device 50.

The numerical controller 40 controls various devices by outputting control signals to the various drive units 42, 44, 46, and 48 and drive-controlling the various driving devices 68, 76, 66, and 80. In the present embodiment, the numerical controller 40 controls the advancing/retreating position of the grinding wheel T that is the position of the wheel head 70 in the X-axis direction by outputting a control signal to the drive unit 42 and drive-controlling the wheel-head driving device 68. The numerical controller 40 also controls the spindle rotational angle of the spindle 74 by outputting a control signal to the drive unit 44 and drive-controlling the spindle driving device 76. The numerical controller 40 also controls the position of the work table 65 in Z-axis direction by outputting a control signal to the drive unit 46 and drive-controlling the work-table driving device 66. The numerical controller 40 also controls the rotational speed of the grinding wheel T by outputting a control signal to the drive unit 48 and drive-controlling the grinding-wheel driving device 80.

The drive unit 44 acquires the actual spindle rotational angle of the spindle 74 from a detection signal of an encoder 76E of the spindle driving device 76 to perform feedback control. The drive unit 42 acquires the actual position of the wheel head 70 in the X-axis direction from a detection signal of an encoder 68E of the wheel-head driving device 68 to perform feedback control. The drive unit 46 acquires the actual position of the work table 65 in the Z-axis direction from a detection signal of an encoder 66E of the work-table driving device 66 to perform feedback control.

Specifically, the movement amount of the work table 65 is detected by the encoder 66E and the drive unit 46. The movement amount of the wheel head 70 toward the work table 65 is detected by the encoder 68E and the drive unit 42. When the movement amount based on a control signal that is a command signal matches the actual movement amount detected by the encoder and the drive unit, a completion signal is transmitted to the numerical controller.

As depicted in FIG. 5, the camshaft 18 as the workpiece W is supported between the center 72 and the center 73 so that the workpiece rotation axis PW that is the shaft center of the camshaft 18 itself including the composite cams 10 is aligned with the spindle rotation axis that is the rotation axis of the spindle 74.

In the cam grinding device 30 described in the present embodiment, the spindle rotation axis (aligned with the workpiece rotation axis PW in the example of FIG. 5) and the grinding wheel rotation axis PT that is the rotation axis of the grinding wheel T extend on the same horizontal surface STM.

The following describes details of control of the control device 64. The control device 64 includes components within a range surrounded by the imaginary line indicated in FIG. 4. The control device 64 controls the respective driving devices that grind the first cam 12 and the second cam 14. Specifically, the control device 64 controls the spindle driving device 76 as the workpiece rotating device, the work-table driving device 66 as the traverse-moving device, and the wheel-head driving device 68 as the plunge-moving device.

Figure 6:
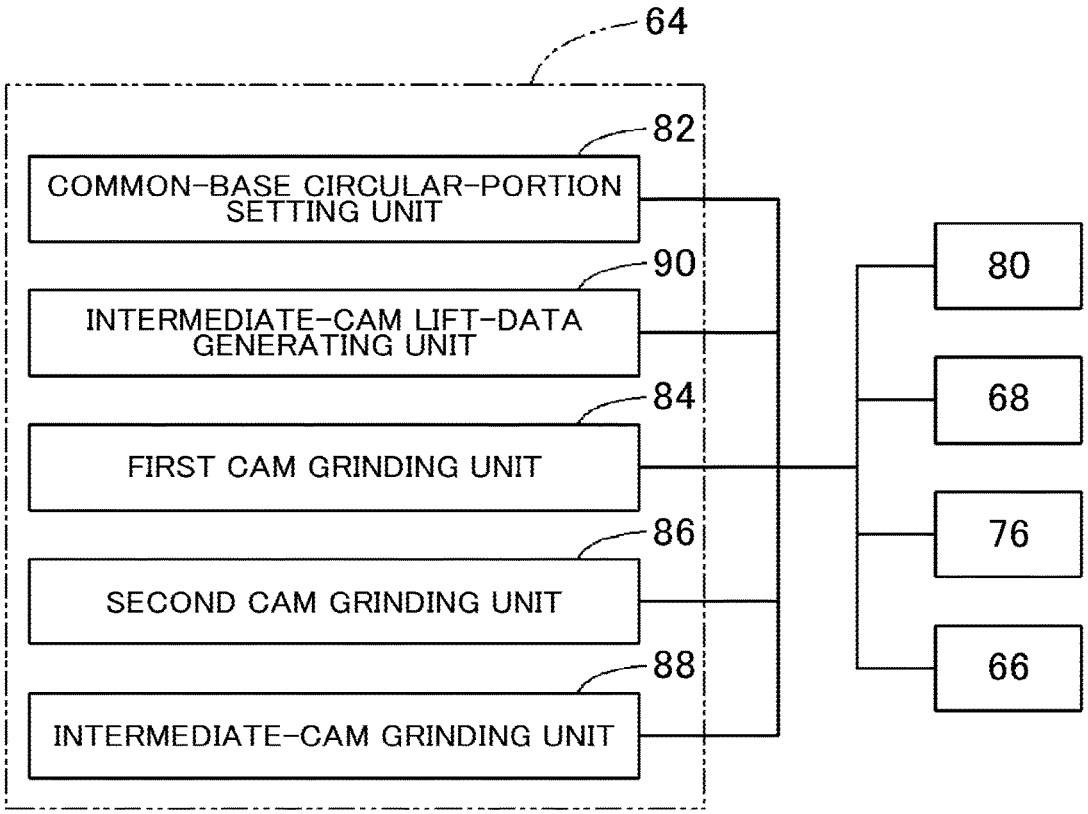
FIG. 6 is a block diagram illustrating control functions of a control device.

As depicted in FIG. 6, the control device 64 includes various control functional units for controlling the respective driving devices. Specifically, the control device 64 includes a common-base circular-portion setting unit 82, an intermediate-cam lift-data generating unit 90, a first cam grinding unit 84, a second cam grinding unit 86, and an intermediate-cam grinding unit 88.

The common-base circular-portion setting unit 82 is a functional unit that sets the common-base circular portion C of the first cam 12 and the second cam 14 on the basis of a program for a common-base circular-portion setting step in a control process flow described later.

The intermediate-cam lift-data generating unit 90 is a functional unit that generates and sets intermediate-cam lift data on the basis of a program for an intermediate-cam lift-data generating step in the control process flow described later.

The first cam grinding unit 84 is a functional unit that grinds the first cam 12 on the basis of a program for a first cam grinding step described later. The second cam grinding unit 86 is a functional unit that grinds the second cam 14 on the basis of a program for a second cam grinding step described later.

The intermediate-cam grinding unit 88 is a functional unit that grinds the imaginary intermediate cam set as described above on the basis of a program for an intermediate-cam grinding step described later.

Figure 7:
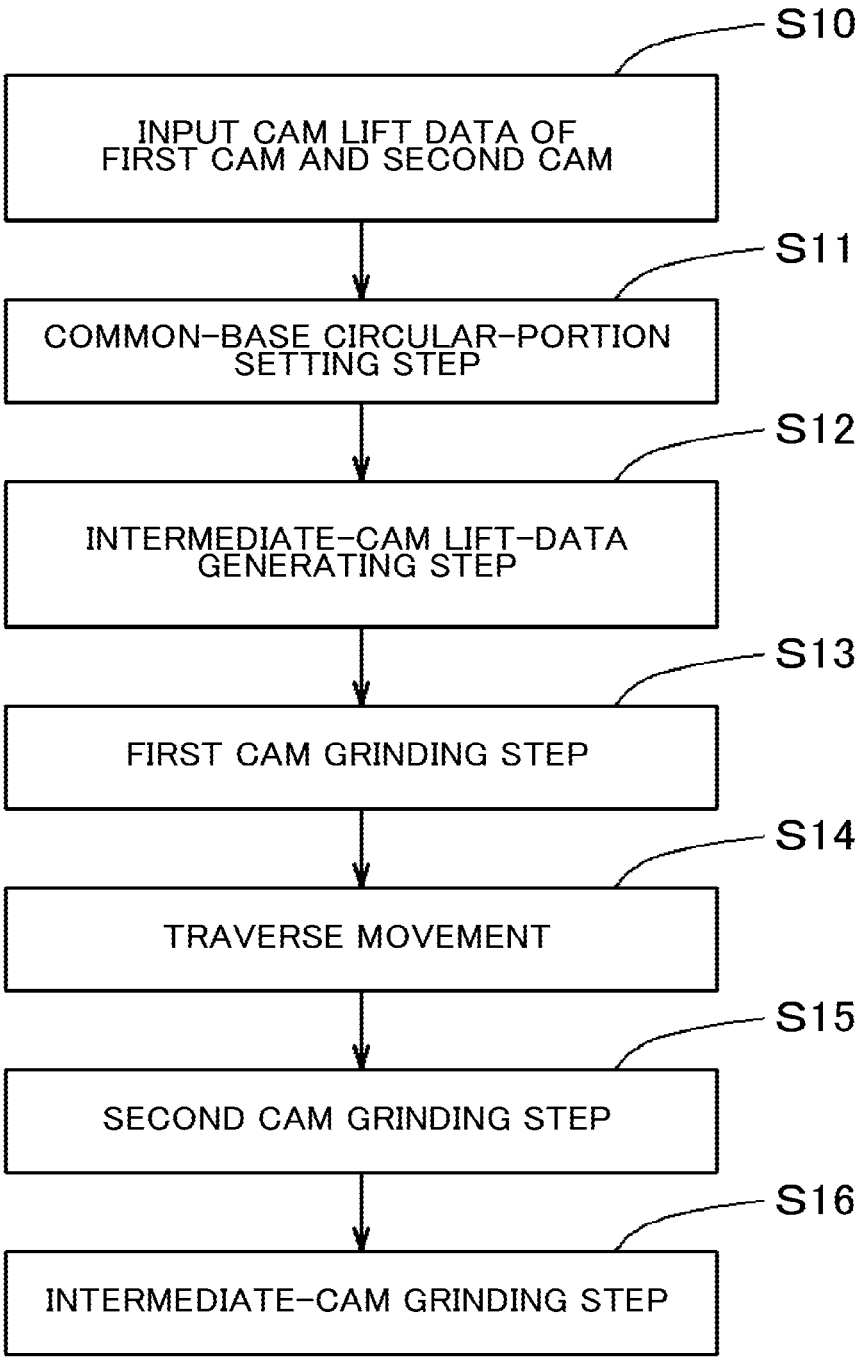
FIG. 7 is a process flow of the present embodiment executed by the control device.

The following describes, with reference to FIG. 7, the control process flow of the present embodiment in which the respective functional units are used to control operation of the respective driving devices.

In the present embodiment, as indicated in the control process flow in FIG. 7, to begin with, at step S10, the first cam lift data and the second cam lift data that respectively represent the outer profile of the first cam 12 and the outer profile of the second cam 14 depicted in FIG. 1 are read as described above.

Subsequently, in the common-base circular-portion setting step at step S11, the common-base circular portion C of the first cam 12 and the second cam 14 are determined. This determination is made based on the first cam lift data containing cam lift heights (lift amounts) set for the corresponding phases in the first cam 12 and the second cam lift data containing cam lift heights (lift amounts) set for the corresponding phases in the second cam 14 depicted in FIG. 1. In the outer peripheral surface of the first base circular portion C1 of the first cam and in the outer peripheral surface of the second base circular portion C2 of the second cam 14 depicted in FIG. 1, an angular range in which these outer peripheral surfaces are formed on the same surface with the radius r is determined as the common-base circular portion C. This common-base circular-portion setting step at step S11 is performed before the following intermediate-cam lift-data generating step.

Subsequently, in the intermediate-cam lift-data generating step at step S12, cam lift data of an imaginary intermediate cam 15 (see FIG. 1) is generated. In this generation for the intermediate cam 15, based on the first cam lift data and the second cam lift data described above, the intermediate-cam lift data of the imaginary intermediate cam that contains the profile of the first cam and the profile of the second cam when viewed from the cam axial direction is generated. The cam lift data of the intermediate cam 15 is generated by, while the reference phases of the cam lift data of both cams are aligned, selecting a greater height out of cam lift heights of two cams at the same phases. By using this cam lift data, a spline curve may be drawn to generate smoothed cam lift data containing new phases and cam lift heights. The intermediate-cam lift data contains the cam lift data of the common-base circular portion described above. This intermediate-cam lift-data generating step at step S12 only needs to be performed before the second cam grinding step described later is completed.

Figure 10:
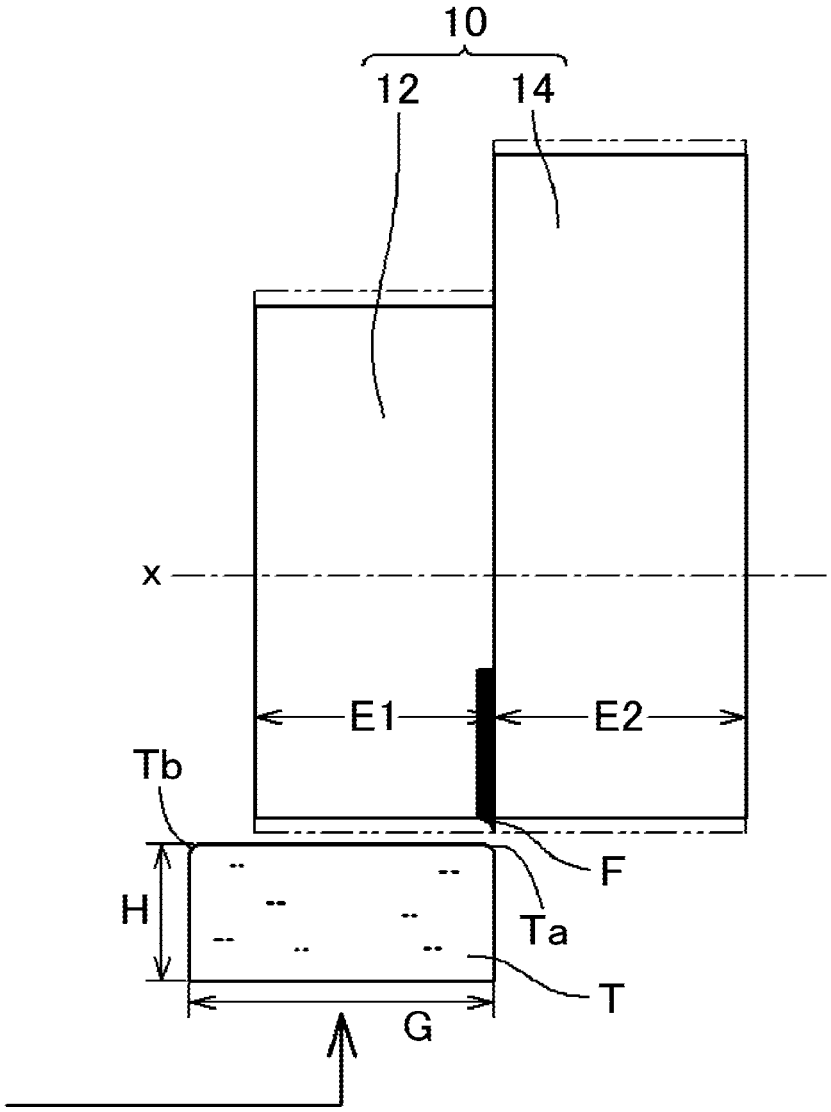
FIG. 10 is an explanatory diagram of first cam grinding.

Subsequently, in the first cam grinding step at step S13, the first cam 12 is ground. FIG. 10 is a schematic diagram illustrating a grinding condition of the first cam grinding step. The grinding wheel T is moved to a position facing the outer peripheral surface of the first cam 12 by the work-table driving device 66 and the wheel-head driving device 68 controlled by the control device 64. The spindle driving device 76 and the wheel-head driving device 68 are then controlled by the control device 64 to plunge grind the first cam 12.

Figure 8:
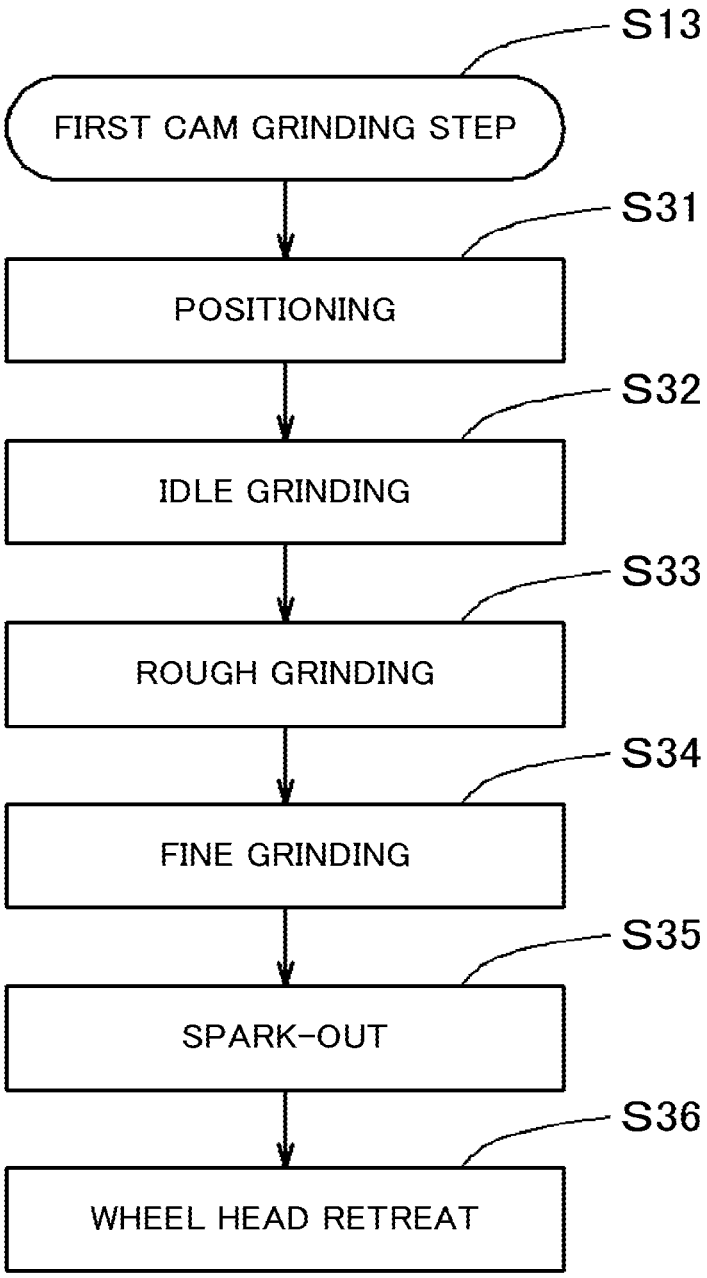
FIG. 8 is a detailed process flow of a first cam grinding step.

FIG. 8 illustrates a detailed process flow of the first cam grinding step S13. As depicted in FIG. 8, grinding of the first cam 12 is performed in the order of positioning S31, idle grinding S32, rough grinding S33, fine grinding S34, spark-out S35, and wheel head retreat S36. At the positioning S31, in a traverse direction (right-and-left direction seen in FIG. 10) in FIG. 10, the work table 65 is moved rightward so that the right end of the first cam 12 is positioned so as to be aligned with the right end of the grinding wheel T. In a plunge direction (up-and-down direction seen in FIG. 10), the wheel head 70 is moved forward so that the grinding wheel T is positioned at a position separated from the axis x of the composite cam 10 toward the wheel head 70 by the radius r+the infeed amount J of the idle grinding+the infeed amount K of the rough grinding+the infeed amount M of the fine grinding.

At the positioning S31, in the traverse direction (right-and-left direction) depicted in FIG. 10, the right end of the grinding wheel T is positioned at the right end of the first cam 12. In the plunge direction (up-and-down direction), the grinding wheel T is positioned at a position apart from the first cam 12 by the infeed amount J of the idle grinding. By the idle grinding, the grinding wheel T moves in the plunge direction by the infeed amount J of the idle grinding, and the grinding wheel T comes into contact with the outer peripheral surface of the first cam 12. From this state, by the rough grinding, the grinding wheel T moves forward in the plunge direction by the infeed amount K of the rough grinding to perform rough grinding. Furthermore, by the fine grinding, the grinding wheel T moves forward in the plunge direction by the infeed amount M of the fine grinding to perform fine grinding. Subsequently, spark-out is performed until the rotation amount of the spindle 74 reaches a predetermined value. After these processes of grinding have been completed, for the next second cam grinding step S15, the wheel head 70 is moved backward in the plunge direction by the value calculated from the infeed amount J+the infeed amount K+the infeed amount M.

Referring back to FIG. 7, after the first cam grinding step S13 has been completed, traverse movement at step S14 is performed. The traverse movement is movement of the grinding wheel T from the position in FIG. 10 to the position in FIG. 11. This is movement by which the work table 65 is moved rightward by the width G of the grinding wheel T in the traverse direction.

Figure 11:
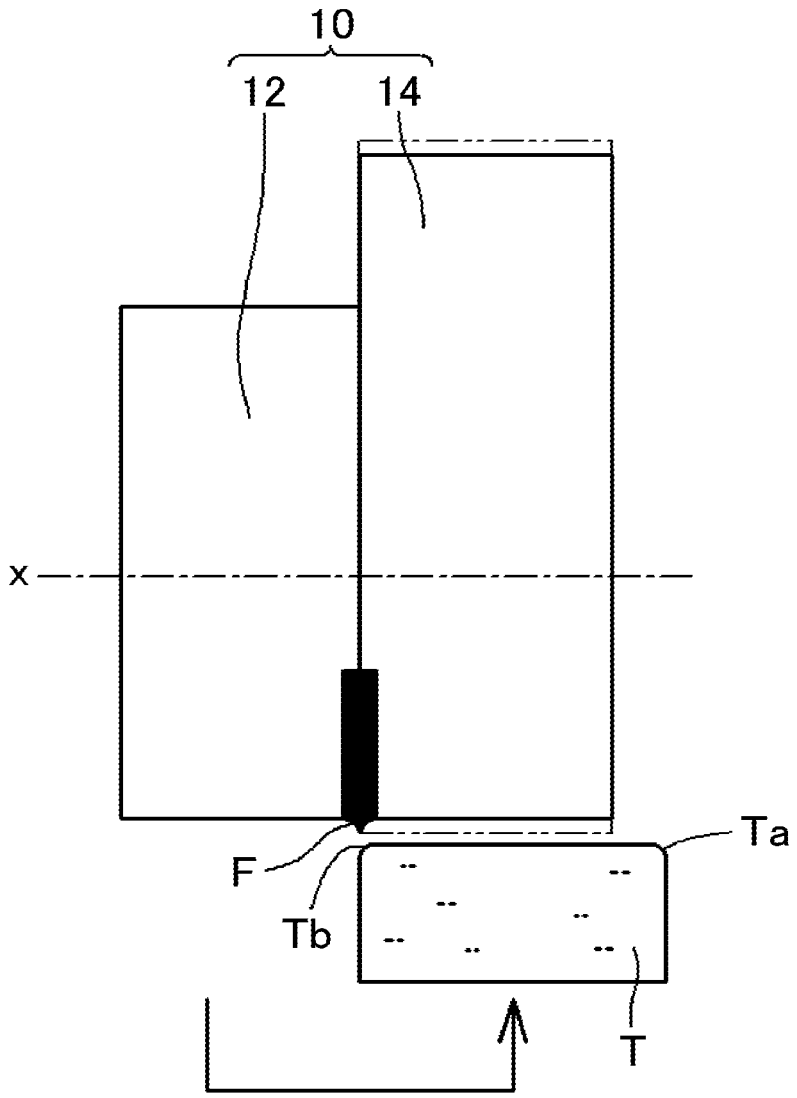
FIG. 11 is an explanatory diagram of second cam grinding.

Subsequently, the second cam grinding step at step S15 is performed. At the second cam grinding step S15, the second cam 14 is ground. FIG. 11 illustrates a grinding condition of the second cam grinding step S15. The grinding wheel T is moved to a position facing the outer peripheral surface of the second cam 14 by the work-table driving device 66 and the wheel-head driving device 68 controlled by the control device 64 over the path indicated by the arrow in FIG. 11. The spindle driving device 76 and the wheel-head driving device 68 are then controlled by the control device 64 to plunge grind the second cam 14.

Figure 9:
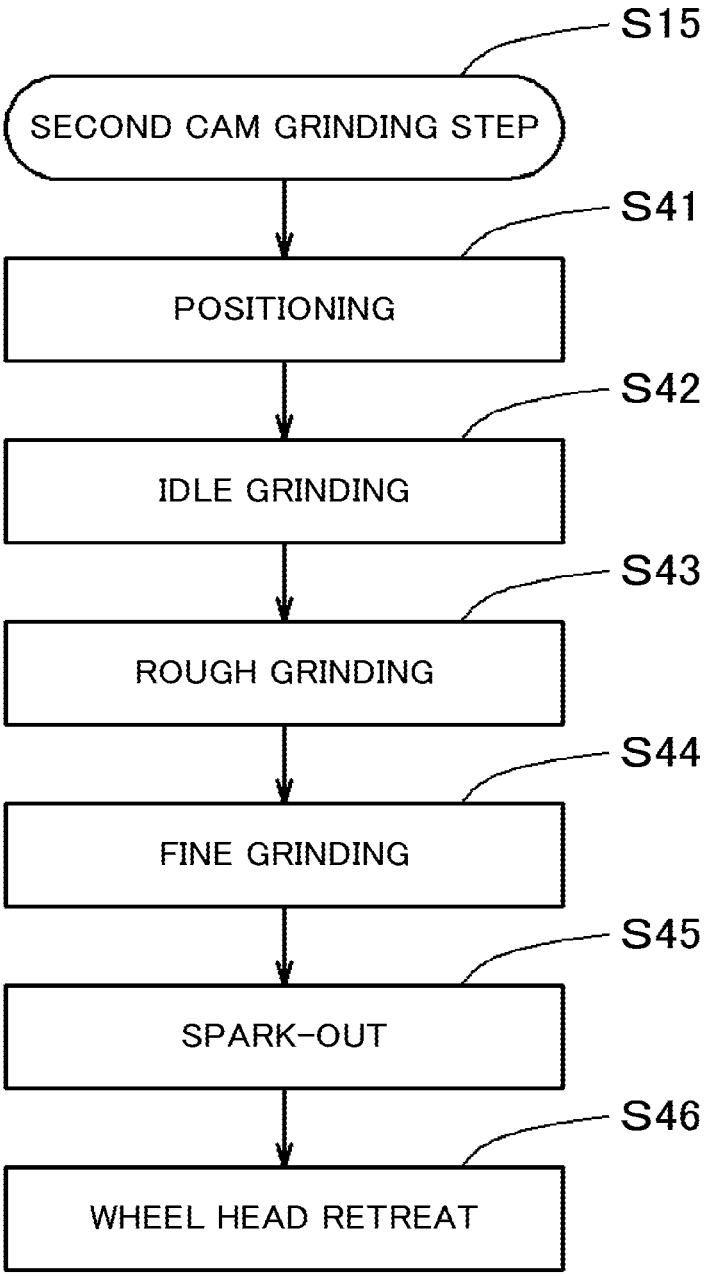
FIG. 9 is a detailed process flow of a second cam grinding step.

FIG. 9 illustrates a detailed process flow of the second cam grinding step S15. As depicted in FIG. 9, grinding of the second cam 14 is performed in the order of positioning S41, idle grinding S42, rough grinding S43, fine grinding S44, and spark-out S45. At the positioning S41, the positioning of the grinding wheel T in the second cam grinding step S15 is performed by the traverse movement S14. At this positioning S41, in the traverse direction, the left end of the grinding wheel T is positioned at the left end of the second cam 14. In the plunge direction, the grinding wheel T is positioned at a position apart from the second cam 14 by the infeed amount J of the idle grinding. At the idle grinding S42, the grinding wheel T is moved forward in the plunge direction by the infeed amount J of the idle grinding. At the rough grinding S43, the grinding wheel T is moved forward in the plunge direction by the infeed amount K of the rough grinding. At the fine grinding S44, the grinding wheel T is moved forward in the plunge direction by the infeed amount M of the fine grinding. Subsequently, at the spark-out S45, spark-out is performed until the rotation amount of the spindle 74 reaches a predetermined value. After these processes of grinding have been completed, the wheel head 70 is moved backward by the infeed amount J at the wheel head retreat S46.

The infeed amount J at the idle grinding in the first cam grinding step S13 and the second cam grinding step S15 is as follows. The infeed amount J at the idle grinding is an amount that is larger than the maximum lift amount of the first cam 12 or the second cam 14 and prevents the grinding wheel T from coming into contact with the first cam 12 and the second cam 14 even if the work table 65 is traversed when the wheel head 70 sits at a position before the idle grinding, that is, the maximum lift amount=the maximum value of lift data−the minimum value of lift data. Herein, the minimum value of lift data is the radius of the first base circular portion C1 and the second base circular portion C2.

At the idle grinding, the rough grinding, the fine grinding, the spark-out in the first cam grinding step S13 and the second cam grinding step S15, the wheel head 70 is moved forward and backward in accordance with the rotational angle of the spindle 74 on the basis of the first cam lift data or the second cam lift data. This forward and backward movement is performed in conjunction with operation of moving forward in the plunge direction by the infeed amount.

The cam grinding in the first cam grinding step S13 and the second cam grinding step S15 is performed through three steps of the rough grinding, the fine grinding, and the spark-out in this order. This enables the grinding time to be shortened. In other words, the cam grinding can be performed through the fine grinding alone, but it takes more time for the grinding. Herein, the spark-out is grinding that does not involve grinding infeed such as plunge grinding. The purpose of performing this spark-out is to improve grinding accuracy by grinding a workpiece W without grinding infeed by an amount of deflection and deformation that have been generated during machining in the workpiece W ground at the fine grinding, thereby removing the deflection and deformation.

After the plunge grinding of the first cam 12 and the second cam 14 with the grinding wheel T in the first cam grinding step S13 and the second cam grinding step S15, an unground portion F remains at a boundary portion between the first cam 12 and the second cam 14. The unground portion F is illustrated, filled with black. It should be noted that the unground portion F and grinding allowances of the first cam 12 and the second cam 14 that are indicated by imaginary lines are drawn in an exaggerated manner for the purpose of easy understanding.

Subsequently, after the second cam grinding step S15, at the intermediate-cam grinding step S16 depicted in FIG. 7, the unground portion F remaining at the boundary portion between the first cam 12 and the second cam 14 is ground to be removed.

Figure 12:
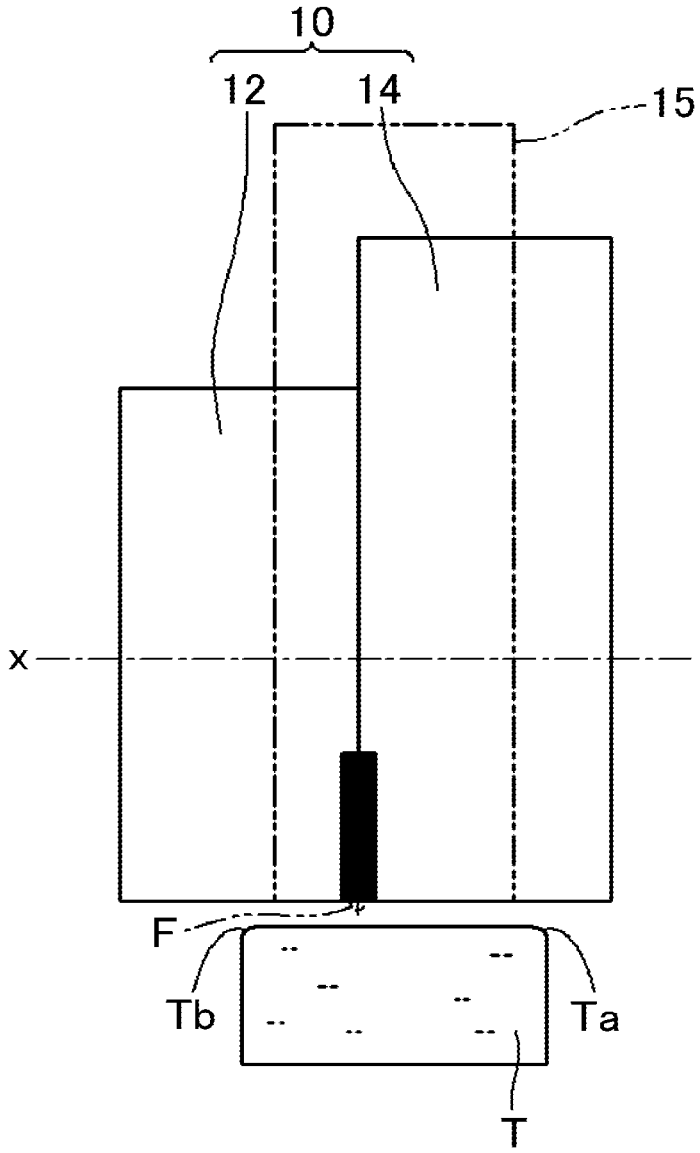
FIG. 12 is an explanatory diagram of intermediate cam grinding.
Figure 13:
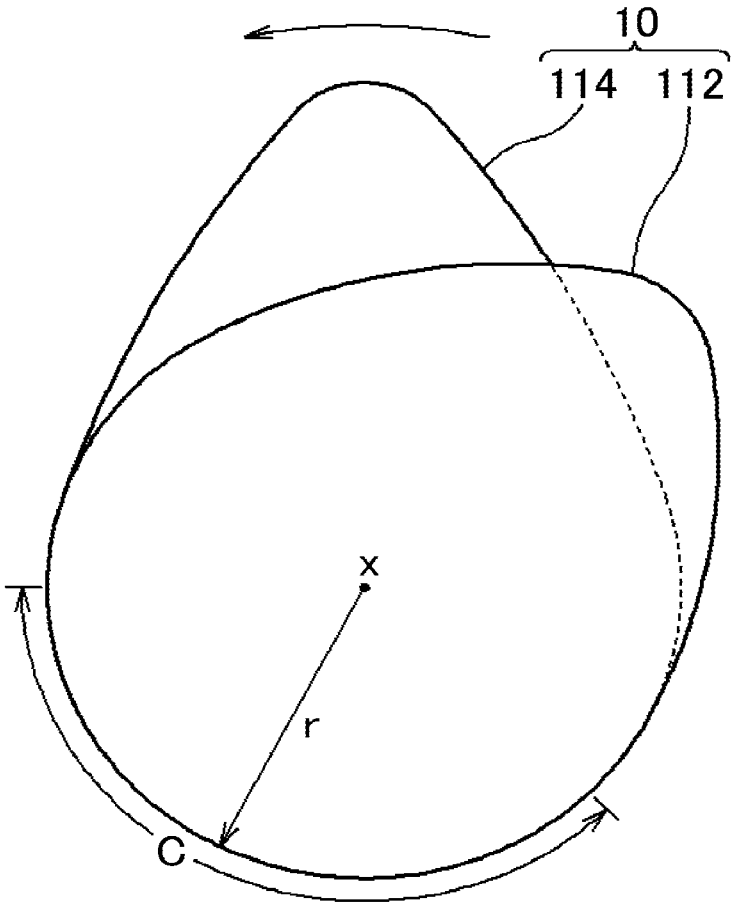
FIG. 13 is a schematic diagram of a composite cam when viewed from a cam axial direction for explaining a related art.
Figure 14:
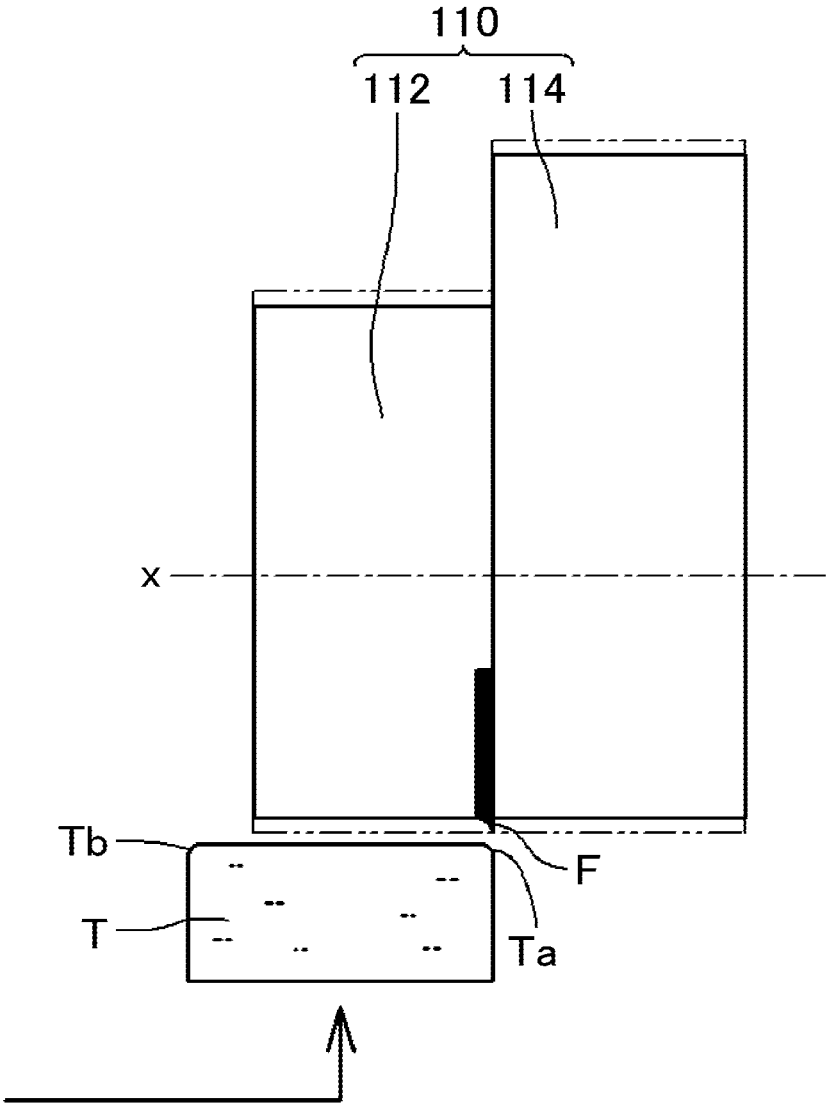
FIG. 14 is a side view of a first cam and a second cam included in the composite cam when viewed from a direction orthogonal to the cam axis, and is a state diagram in which the first cam is ground.
Figure 15:
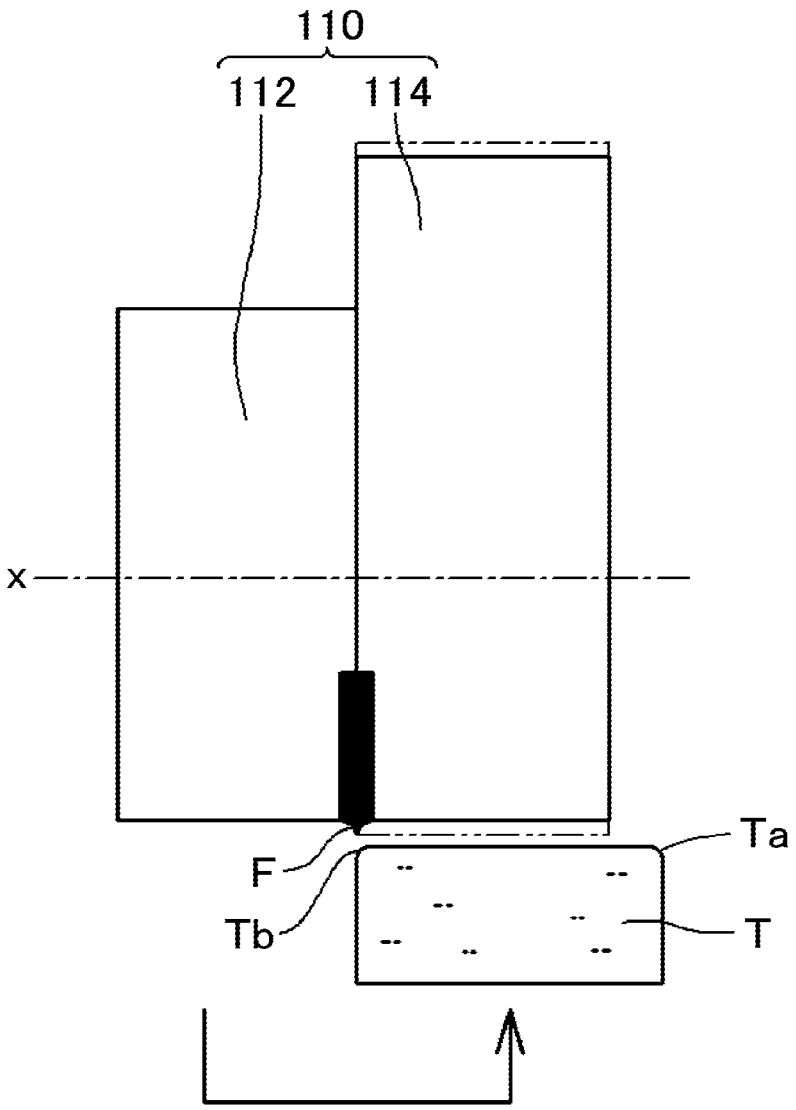
FIG. 15 is a state diagram in which the second cam is ground.

FIG. 12 is a schematic diagram illustrating a grinding condition of the intermediate-cam grinding step. In the present embodiment, the imaginary set position of the intermediate cam 15 is in an intermediate position extending over both of the first cam 12 and the second cam 14 when viewed from the axial direction. This intermediate position is a position containing the unground portion F generated at the boundary portion between the first cam 12 and the second cam 14.

The grinding wheel T is positioned to a position corresponding to the imaginary set position of the intermediate cam 15 by the work-table driving device 66 controlled by the control device 64. The spindle driving device 76 and the wheel-head driving device 68 are controlled, whereby the wheel head 70 is moved forward in the plunge direction by the infeed amount J, and the wheel head 70 is moved forward and backward according to the rotational angle of the spindle 74 on the basis of the intermediate-cam lift data of the intermediate cam 15. The grinding of the intermediate cam 15 is performed as spark-out grinding. Together with this spark-out grinding, grinding to remove the unground portion F at the boundary portion is performed. The spark-out grinding is grinding to grind part of the first cam 12 and part of the second cam 14, which is performed continuously while the spindle 74 rotates several times, and thus is advantageous in that the unground portion F at the boundary portion between both cams can be reliably removed.

The wheel head 70 is moved forward and backward in accordance with the rotational angle of the spindle 74 on the basis of the intermediate-cam lift data, and simultaneously the wheel head 70 is moved backward in the plunge direction by the infeed amount J, and thus the spark-out grinding of the intermediate cam 15 is completed.

In the present embodiment, the unground portion F generated at the boundary portion between the first cam 12 and the second cam 14 at the first cam grinding step S13 and the second cam grinding step S15 is removed at the intermediate-cam grinding step S16. Thus, when the tappet 22 is relatively moved between the first cam 12 and the second cam 14, unlike the related art, the tappet 22 does not get over the unground portion F, and this movement can be performed smoothly. Consequently, the grinding wheel does not have to be replaced more frequently, and the grinding wheel does not have to be dressed sooner.

In the present embodiment, the cam profile of the first cam 12 in the lift-height direction and the cam profile of the second cam 14 in the lift-height direction are offset from each other in the angular direction, and are in a positional relation in which these cams protrude from each other when viewed from the cam axial direction. Even in this positional relation, according to the present embodiment, the unground portion F can be reliably ground by grinding the intermediate cam 15.

In the foregoing, a specific embodiment of the present invention has been described. However, the present invention may be applied to other various embodiments.

For example, the axial direction widths of the first cam and the second cam are the same in the embodiment above, but may be different. In this case, attention needs to be paid to the fact that the contact pressure applied by the grinding wheel T during plunge grinding is different therebetween.

In the examples described above, description has been made under the assumption that the first cam 12 is a cam for low speed and the second cam 14 is a cam for high speed, but these may be inverted.

What is claimed is:

1. A cam grinding device that grinds a composite cam including: a first cam having a first base circular portion in which lift height from a shaft center to an outer peripheral surface is formed by a first radius that is constant and a first cam portion in which the lift height from the shaft center to the outer peripheral surface changes; and a second cam having a second base circular portion in which lift height from the shaft center to an outer peripheral surface is formed by the first radius that is constant and a second cam portion in which the lift height from the shaft center to the outer peripheral surface changes, wherein the first cam and the second cam are arranged adjacently in an axial direction so as to be coaxial, and the first cam and the second cam have shapes that respectively correspond to first cam lift data and second cam lift data that are different from each other, and at least part of the outer peripheral surface of the first base circular portion and at least part of the outer peripheral surface of the second base circular portion form a common-base circular portion formed on an identical surface, the cam grinding device comprising:

a bed serving as a base;

a spindle device mounted on the bed and including a workpiece rotating device configured to support the composite cam so that the composite cam is rotatable about the shaft center;

a grinding-wheel device mounted on the bed and including a grinding wheel configured to rotate;

a traverse-moving device that is capable of reciprocating the grinding wheel relatively to the composite cam in the axial direction;

a plunge-moving device that is capable of moving the grinding wheel relatively to the composite cam in a direction crossing the axial direction; and a control device configured to control the workpiece rotating device, the traverse-moving device, and the plunge-moving device; wherein the control device includes:

a common-base circular-portion setting unit configured to determine an angular range of the common-base circular portion that is formed on the identical surface by the at least part of the outer peripheral surface of the first base circular portion and the at least part of the outer peripheral surface of the second base circular portion, based on the first cam lift data that contains a lift amount corresponding to a rotational angle in the first cam and the second cam lift data that contains a lift amount corresponding to a rotational angle in the second cam;

an intermediate-cam lift-data generating unit configured to generate intermediate-cam lift data of an imaginary intermediate cam that contains a profile of the first cam and a profile of the second cam when viewed from the axial direction, based on the first cam lift data and the second cam lift data;

a first cam grinding unit that controls the plunge-moving device and the traverse-moving device to move the grinding wheel to a position facing the outer peripheral surface of the first cam, and controls the workpiece rotating device and the plunge-moving device based on the first cam lift data to grind the first cam;

a second cam grinding unit that, in a state in which the grinding wheel has retreated from the composite cam after the first cam has been ground, controls the traverse-moving device to move the grinding wheel to a position facing the outer peripheral surface of the second cam, and controls the workpiece rotating device and the plunge-moving device based on the second cam lift data to grind the second cam; and an intermediate-cam grinding unit that, in a state in which the grinding wheel has retreated from the composite cam after the second cam has been ground, controls the traverse-moving device to move the grinding wheel to a position corresponding to a boundary between the first cam and the second cam, and controls the workpiece rotating device and the plunge-moving device based on the intermediate-cam lift data to grind the imaginary intermediate cam.

2. The cam grinding device according to claim 1, wherein grinding of the first cam and grinding of the second cam respectively performed by the first cam grinding unit and the second cam grinding unit each include rough grinding, fine grinding, and spark-out.

3. A cam grinding method for grinding a composite cam including: a first cam having a first base circular portion in which lift height from a shaft center to an outer peripheral surface is formed by a first radius that is constant and a first cam portion in which the lift height from the shaft center to the outer peripheral surface changes; and a second cam having a second base circular portion in which lift height from the shaft center to an outer peripheral surface is formed by the first radius that is constant and a second cam portion in which the lift height from the shaft center to the outer peripheral surface changes, wherein the first cam and the second cam are arranged adjacently in an axial direction so as to be coaxial, and the first cam and the second cam have shapes that respectively correspond to first cam lift data and second cam lift data that are different from each other, and at least part of the outer peripheral surface of the first base circular portion and at least part of the outer peripheral surface of the second base circular portion form a common-base circular portion formed on an identical surface, the cam grinding method comprising:

a common-base circular-portion setting step of determining an angular range of the common-base circular portion that is formed on the identical surface by the at least part of the outer peripheral surface of the first base circular portion and the at least part of the outer peripheral surface of the second base circular portion, based on the first cam lift data that contains a lift amount corresponding to a rotational angle in the first cam and the second cam lift data that contains a lift amount corresponding to a rotational angle in the second cam;

an intermediate-cam lift-data generating step of generating intermediate-cam lift data of an imaginary intermediate cam that contains a profile of the first cam and a profile of the second cam when viewed from the axial direction, based on the first cam lift data and the second cam lift data;

a first cam grinding step of moving a grinding wheel to a position facing the outer peripheral surface of the first cam, and plunge grinding the first cam with the grinding wheel based on the first cam lift data;

a second cam grinding step of, in a state in which the grinding wheel has retreated from the composite cam after the first cam has been ground, moving the grinding wheel to a position facing the outer peripheral surface of the second cam, and plunge grinding the second cam with the grinding wheel based on the second cam lift data; and an intermediate-cam grinding step of, in a state in which the grinding wheel has retreated from the composite cam after the second cam has been ground, moving the grinding wheel to a position corresponding to a boundary between the first cam and the second cam, and grinding the imaginary intermediate cam lying on the boundary between the first cam and the second cam based on the intermediate-cam lift data.

* * * * *